US011761201B2

(12) United States Patent
Schmitz et al.

(10) Patent No.: US 11,761,201 B2
(45) Date of Patent: Sep. 19, 2023

(54) PARTITION WALL

(71) Applicants: Burkhard Schmitz, Berlin (DE); Carola Zwick, Berlin (DE); Roland Zwick, Berlin (DE)

(72) Inventors: Burkhard Schmitz, Berlin (DE); Carola Zwick, Berlin (DE); Roland Zwick, Berlin (DE)

( * ) Notice: Subject to any disclaimer, the term of this patent is extended or adjusted under 35 U.S.C. 154(b) by 791 days.

(21) Appl. No.: 16/671,255

(22) Filed: Nov. 1, 2019

(65) Prior Publication Data

US 2020/0109558 A1 Apr. 9, 2020

Related U.S. Application Data

(63) Continuation of application No. PCT/EP2018/061203, filed on May 2, 2018.

(30) Foreign Application Priority Data

May 4, 2017 (DE) ..... 10 2017 109 612.4

(51) Int. Cl.
*E04B 2/74* (2006.01)
*G10K 11/172* (2006.01)
(Continued)

(52) U.S. Cl.
CPC ..... *E04B 2/7433* (2013.01); *G10K 11/16* (2013.01); *G10K 11/172* (2013.01);
(Continued)

(58) Field of Classification Search
CPC ..... E04B 1/8409; E04B 2/7433; E04B 2002/7479; E04B 2002/7483; G10K 11/172; G10K 11/16
See application file for complete search history.

(56) References Cited

U.S. PATENT DOCUMENTS 1,992,782 A * 2/1935 Smith ..... E06B 7/03 454/214
3,466,777 A * 9/1969 Wistrand ..... E04B 2/7854 52/285.3
(Continued)

FOREIGN PATENT DOCUMENTS

DE 20 2015 102 968 U1 7/2015
GB 346792 A 4/1931
(Continued)

OTHER PUBLICATIONS

English translation of International Preliminary Report on Patentability (Chapter I) (Application No. PCT/EP2018/061203) dated Nov. 14, 2019, 7 pages.
(Continued)

*Primary Examiner* — Jessie T Fonseca
(74) *Attorney, Agent, or Firm* — BURR PATENT LAW, PLLC

(57) ABSTRACT

The invention relates to a partition wall which comprises a wall element and a stand device, wherein the wall element comprises a multiplicity of tubular bodies, each having a cavity, which are vertically aligned in the room. The wall element herein comprises spacer webs, wherein one of the spacer webs is in each case disposed between neighbouring tubular bodies of the wall element in such a manner that the tubular bodies are aligned so as to be mutually parallel and mutually spaced apart.

12 Claims, 13 Drawing Sheets

(51) Int. Cl.
*G10K 11/16* (2006.01)
*E04B 1/84* (2006.01)

(52) U.S. Cl.
CPC ..... *E04B 1/8409* (2013.01); *E04B 2002/7479* (2013.01); *E04B 2002/7483* (2013.01)

(56) References Cited

U.S. PATENT DOCUMENTS 4,042,005 A * 8/1977 Hammerstein ..... E06B 9/165 160/220
4,241,777 A 12/1980 Wenger et al.
6,206,079 B1 3/2001 Selgrad
D944,020 S * 2/2022 MacAllen ..... D6/332
D951,662 S * 5/2022 MacAllen ..... D6/332
2004/0143932 A1* 7/2004 Chen ..... E04B 2/7431 16/83
2013/0091775 A1* 4/2013 Saccomanno ..... E05D 15/12 49/506
2016/0289955 A1 10/2016 Schmitz et al.
2016/0348358 A1* 12/2016 Udagawa ..... E04B 2/7405
2017/0370098 A1 12/2017 Honji et al.

FOREIGN PATENT DOCUMENTS

GB 2 295 077 A 5/1996
JP 2003166383 A * 6/2003
WO 2016/136740 A1 9/2016

OTHER PUBLICATIONS

European Office Action (Application No. 18 721 786.4) dated Jul. 28, 2021.
International Search Report and Written Opinion (Application No. PCT/EP2018/061203) dated Aug. 6, 2018.

* cited by examiner

PARTITION WALL

CROSS REFERENCE TO RELATED APPLICATIONS

This application is a continuation of International Application No. PCT/EP2018/061203 filed May 2, 2018, which designated the United States, and claims the benefit under 35 USC § 119(a)-(d) of German Application No. 10 2017 109 612.4 filed May 4, 2017, the entireties of which are incorporated herein by reference.

FIELD OF THE INVENTION

The present invention relates to a partition wall.

BACKGROUND OF THE INVENTION

A partition wall which comprises a wall element and a stand device is known from DE 20 2015 102 968 U1, wherein the wall element comprises a multiplicity of tubular bodies, each having a cavity, that are vertically aligned in the room.

SUMMARY OF THE INVENTION

The present invention is based on the object of developing a partition wall which has high flexibility and nevertheless has a high degree of inherent stability and good sound-absorbing properties.

It is provided according to the present invention that the wall element comprises spacer webs, wherein one of the spacer webs is in each case disposed between neighbouring tubular bodies of the wall element in such a manner that the tubular bodies are aligned so as to be mutually parallel and mutually spaced apart. On account thereof, the wall element of the partition wall has increased flexibility since the former is formed by tubular bodies only in portions. Thus, in particular, a curved progression of the wall element that stands vertically in the room is also implementable in the form of an integral and continuous wall element. The core concept of the present invention, therefore, lies in a combination of flexurally compliant portions and of portions having a great sound-absorbing effect and a great stability-imparting effect.

It is also provided that the tubular bodies are configured as hollow profiles, wherein the hollow profiles have an internal cross section that is similar to a circle or is polygonal and, in particular, hexagonal, and an external cross section that is similar to a circle or is polygonal and, in particular, hexagonal. On account of internal cross sections and external cross sections, respectively, of this type, a structure of the wall element that has a high bending moment is achieved, such that a permanently crease-free progression of the wall element of the partition wall is ensured, and also a vertical alignment of the wall element across the longitudinal extent of the latter is ensured.

It is provided that the individual spacer webs are each connected by way of opposite edges to the respective neighbouring tubular bodies. A parallel alignment of the neighbouring tubular bodies is guaranteed on account thereof.

It is also provided that the wall element is configured in at least two layers, wherein a first layer forms a front visible side of the wall element, and wherein a second layer forms a rear visible side of the wall element, and wherein the layers in the region of the spacer webs bear on one another in a planar manner and, in particular, are connected to one another in a planar manner and, in particular, are adhesively bonded and/or welded and/or sewn to one another. On account thereof, the wall element can be made in an efficient manner from a plurality of tiers of a planar material. In particular, webs or sheets from felt or plastic or cardboard or leather or metal, or from a sandwich construction from at least two of these materials, are provided as material herein.

It is also provided that the partition wall as a stand device comprises at least two floor supports, wherein each floor support comprises a foot and a holder, and wherein each holder is connected to the wall element. On account thereof, a partition wall which is held by floor supports to an arbitrary extent can be constructed using a minimum of different components.

It is furthermore provided that the holder of the floor support comprises a vertical stand. An optimal support of the wall element in the room is ensured on account thereof.

It is provided that the vertical stand is adapted to a cavity of one of the tubular bodies of the wall element in such a manner that the tubular body acquires an alignment of the vertical stand when the vertical stand is push-fitted into the tubular body. On account thereof, a vertical alignment of the wall element in the region of the floor supports thereof is ensured, wherein a vertical alignment of the wall element between the floor supports in this instance is guaranteed by the above-mentioned inherent stability of the wall element.

It is also provided that the holder of the floor support is equipped with at least two vertical stands that are aligned so as to be mutually parallel. On account thereof, the alignment of the wall element can be influenced to a greater extent by means of the floor support.

In the case of holders having a plurality of vertical stands it is provided that either at least two of the vertical stands are adapted in such a manner to the cavities of the tubular bodies of the wall element that are connected to the vertical stands that each of the connected tubular bodies acquires an alignment of the push-fitted vertical stand, such that the wall element can be aligned or stabilized, respectively, across a greater amount of distance; or that at least two of the vertical stands are disposed outside the cavities of the tubular bodies at a spacing equal to a thickness of one of the spacer webs in such a manner that the vertical stands upon being push-fitted receive therebetween one of the spacer webs of the wall element in a clamping manner, such that there is no engagement in the cavities of individual wall elements, and the wall element on account thereof in terms of the sound-absorbing properties thereof is influenced to the minimum extent possible; or that at least one first of the vertical stands is adapted to a cavity of one of the tubular bodies of the wall element in such a manner that the tubular body acquires an alignment of the vertical stand when the vertical stand is push-fitted into the tubular body, and at least one second of the vertical stands is disposed outside the cavities of the tubular bodies and, in particular, is disposed in such a manner that the at least one second of the vertical stands bears on the wall element so as to be neighbouring to the at least one push-fitted vertical stand, such that the advantages of an inward bearing and of an outward bearing of the holder on the wall element can be combined.

It is furthermore provided that at least one of the vertical stands comprises at least one coupling mechanism. On account thereof, the potential for the vertical stand and, thus, the floor support to not only be used exclusively for aligning the wall element in the room but for at least one additional function to be imparted to the vertical stand and thus to the floor support is achieved.

It is provided, in particular, that the vertical stand is plug-fitted into the cavity of one of the tubular bodies of the wall element, and that at least one of the coupling means of the vertical stand is disposed in the region of the cavity into which the vertical stand is plug-fitted, and that the tubular body into which the vertical stand is plug-fitted has at least one clearance which is aligned to one of the coupling mechanisms, the coupling mechanism being accessible from the outside by way of the clearance. On account thereof, it is possible for one or multiple coupling mechanisms of the vertical stand of the floor support to be then utilized also when the vertical stand is plug-fitted into the wall element and one or multiple coupling mechanisms is/are located in one of the cavities of the wall element.

It is also provided that the partition wall comprises at least one add-on part, wherein each add-on part comprises at least one flange and by way of the latter, in particular, so as to pass through one of the clearances of one of the tubular bodies of the wall element, is connected to one of the coupling mechanisms of one of the vertical stands. On account thereof, add-on parts can be securely fastened in the region of the wall element by means of the vertical stands.

It is provided, in particular, that the add-on part is configured as an arm and, in particular, as a holding arm, or as a support foot, or as a cross stay, or as a diagonal stay. On account thereof, the partition wall is extended in a various ways and adapted to particular requirements.

It is also provided that the partition wall comprises at least one furniture part, wherein the furniture part is connected directly to at least one of the vertical stands and/or indirectly, by at least one add-on part, to at least one of the vertical stands. On account thereof, the scope of functionality of the wall element can still be extensively expanded, wherein further stabilizing of the partition wall is also performed by the furniture parts.

It is furthermore provided that a plurality of spacer webs of the wall element and, in particular, all spacer webs of the wall element are elastically deformable and, in particular, flexural about bending axes that run parallel with longitudinal axes of the tubular bodies, and/or that the wall element at a plurality of and, in particular, at all transition points between the spacer webs and the adjacent tubular bodies is elastically deformable and, in particular, flexural about bending axes that run parallel with longitudinal axes of the tubular bodies. On account thereof, a curved progression of the partition wall can be readily implemented, since the partition wall in this way has a multiplicity of bending axes which can be utilized.

It is furthermore provided that the partition wall comprises at least one head, wherein the head comprises at least one anchor and one adapter, wherein the adapter is connected to the anchor or anchors, respectively, and wherein the anchor or anchors, respectively, either is/are plug-fittable from above into at least one of the cavities of the wall element or into at least one vertical stand that is plug-fitted into the cavity, and/or is/are placeable from above onto the wall element in such a manner that the anchor or anchors, respectively, bears/bear laterally on at least one of the spacer webs and/or on at least one of the tubular bodies. On account thereof, the scope of functionality of the partition wall is expanded, in particular, so as to be independent of any positioning of the floor supports.

It is also provided that the partition wall comprises accessory parts such as storage units, bezels, lamps, and the like, which are fastenable to the adapter. In the case of a wall element that is aligned in the space, these accessory parts can be retrofitted so as to be freely positioned on the wall element.

It is finally provided that the partition wall comprises at least one second wall element, and that the partition wall comprises at least two floor supports which each comprise at least one vertical stand which has a length which is greater than a height of the first partition wall in the region of the respective floor support, wherein the vertical stands are connected to the second wall element in such a manner that the latter is held above the first wall element so as to correspond to an alignment of the vertical stands. On account thereof, the wall element in terms of the height thereof can be adapted to individual requirements in a simple manner, without a new blank of the wall element having to be made and installed. Furthermore, cutting waste which is created in the production of a wall element having variable heights is also minimized in this way.

BRIEF DESCRIPTION OF THE DRAWINGS

Further details of the present invention will be described in the drawing by schematically illustrated exemplary embodiments.

DETAILED DESCRIPTION OF THE INVENTION

Figure 1:
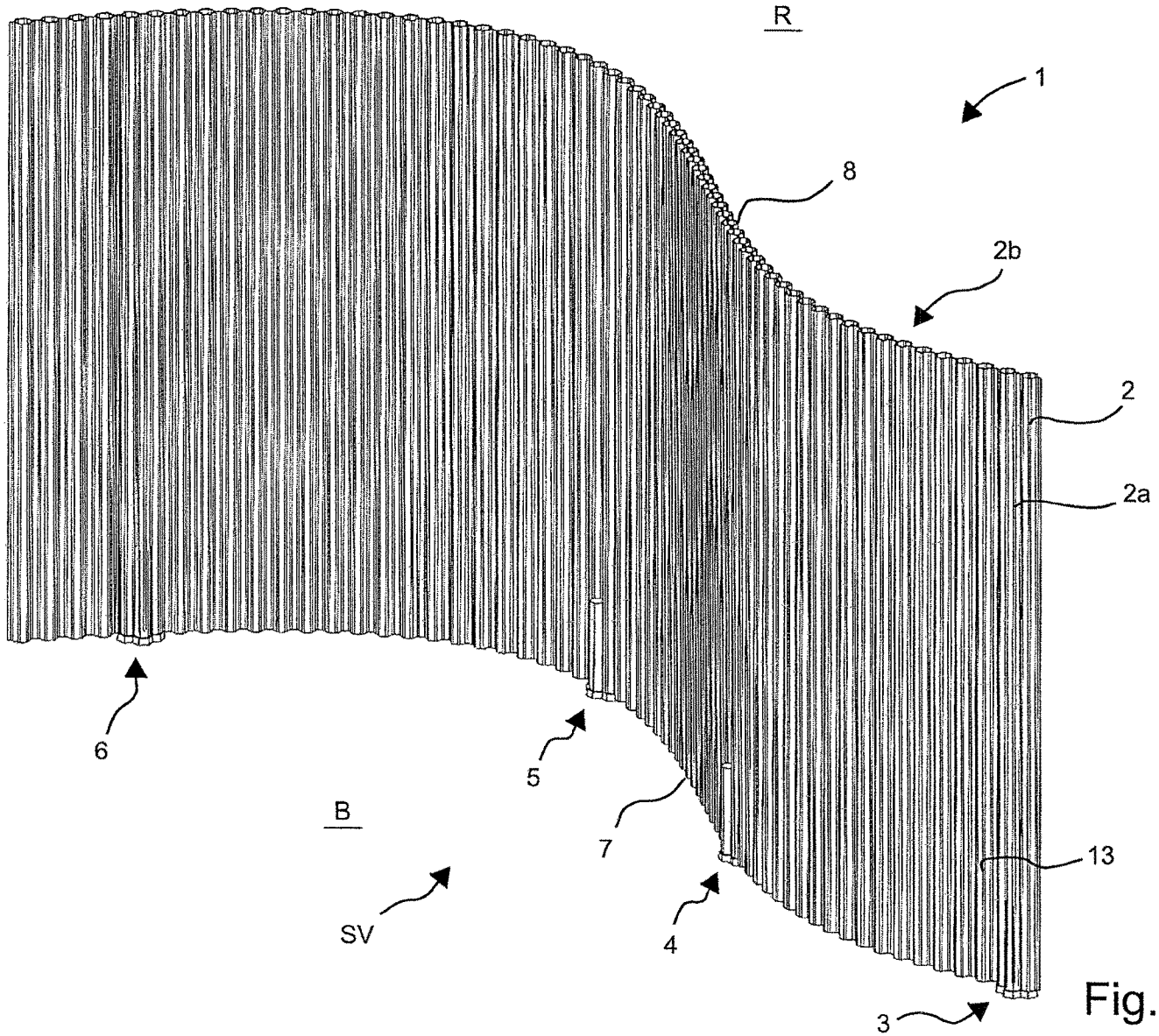
FIG. 1 shows a perspective view of a first variant of embodiment of a partition wall.

A perspective view of a first variant of embodiment of a partition wall 1 is shown in FIG. 1. FIGS. 2*a* to 3*b* show details of this partition wall 1. The partition wall 1 comprises one wall element 2 and four floor supports 3, 4, 5, 6. The wall element 2 of the partition wall 1 has a front visible side 2*a* and a rear visible side 2*b*, and by way of the four floor supports 3, 4, 5, and 6 like a ribbon having an S-shaped progression is aligned vertically in a room R. A base edge 7 and a head edge 8 that is opposite the base edge herein run in planes which are aligned so as to be parallel with a floor B of the room R. The floor supports 3 to 6 form a stand device SV.

Figure 2A:
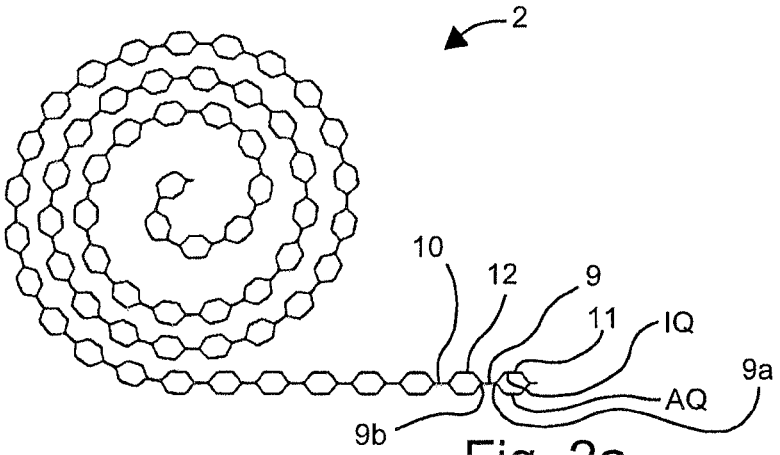
FIGS. 2*a*, 2*b* show the wall element of the partition wall shown in FIG. 1 in a rolled-up state, in a perspective view and in a plan view.
Figure 2B:
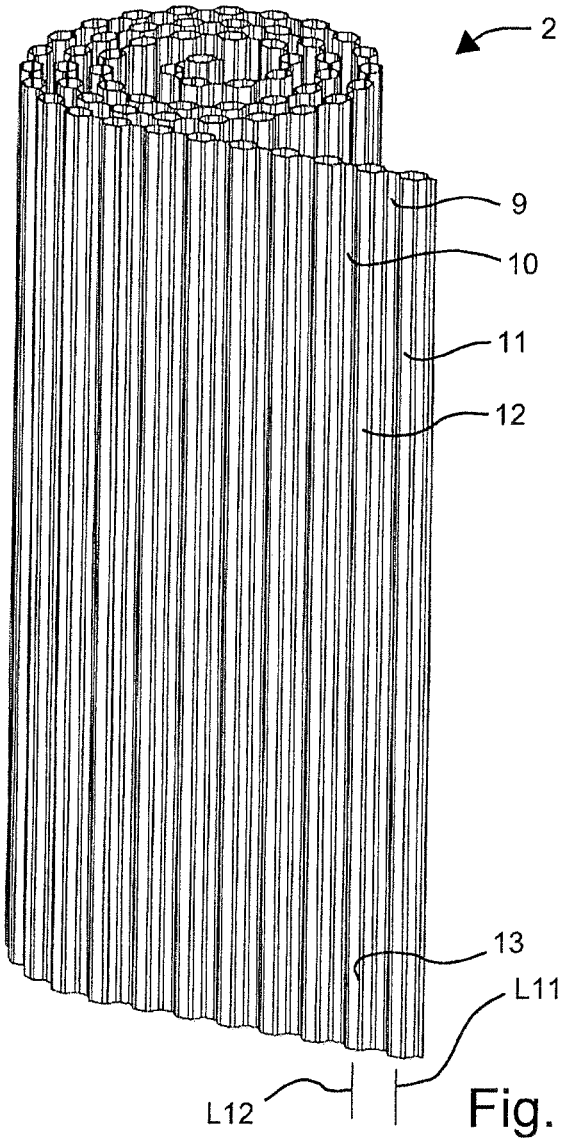

As can be seen in the illustrations of FIGS. 2*a* and 2*b* which show the wall element 2 in the rolled-up state in a stand-alone view, the wall element 2 comprises a multiplicity of spacer webs 9, 10 (identified in an exemplary manner only) and a multiplicity of tubular bodies 11, 12 (identified in an exemplary manner only) which are also referred to as hollow profiles 11, 12. The tubular bodies 11, 12 of the wall element 2 in terms of the longitudinal axes L11, L12 of the former are all aligned so as to be mutually parallel and mutually spaced apart. To this end, one spacer web 9 is in each case always disposed between two neighbouring hollow profiles 11, 12. As can be seen in FIG. 2*a*, the hollow profiles 11, 12 have a hexagonal external cross section AQ and a hexagonal internal cross section IQ. It can also be seen in FIG. 2*a* that the spacer web 9 by way of opposite edges 9*a*, 9*b* which run parallel to the longitudinal axes L11, L12 is connected to the hollow profile 11 and to the hollow profile 12.

Figure 3A:
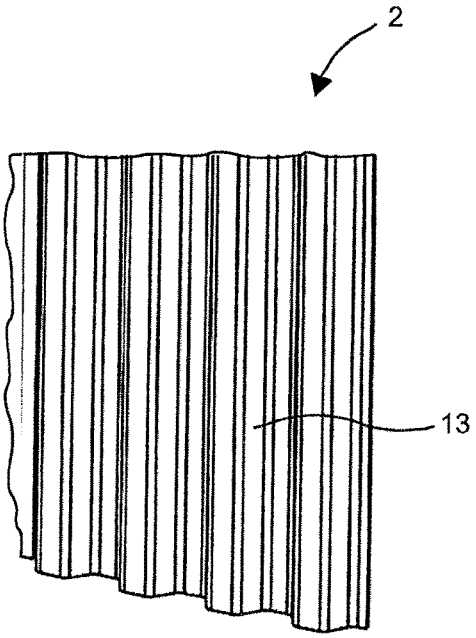
FIG. 3*a* shows a corner region of the wall element shown in FIGS. 1, 2*a*, and 2*b;*
Figure 3B:
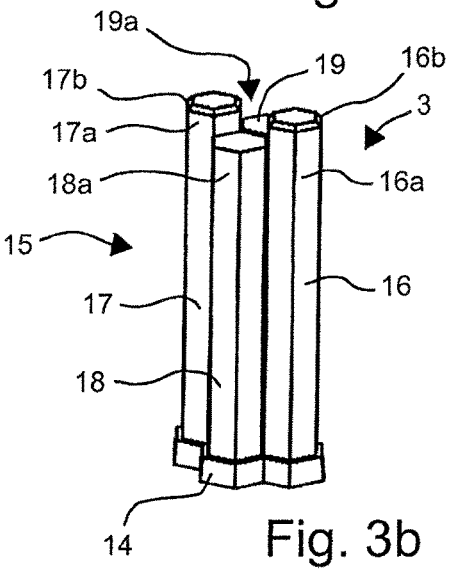
FIG. 3*b* shows a floor support of the partition wall shown in FIG. 1, the floor support being provided for push-fitting into the corner region shown in FIG. 3.

Shown in FIG. 3*a*, and also visible in FIGS. 1 and 2*b*, is a right hand lower corner region 13 of the wall element 2 into which the floor support 3 shown in a stand-alone view in FIG. 3*b* is push-fitted in the assembled state of the partition wall 1 (cf. FIG. 1). The floor support 3 herein comprises one foot 14 and one holder 15, wherein the holder 15 comprises four vertical stands 16, 17, 18, and 19. The vertical stands 16, 17, and 18, 19 are mutually spaced apart such that the vertical stands 16, 17, as is shown in FIG. 1, for connecting the floor support 3 to the wall element 2 are push-fittable from below into the tubular bodies 11, 12, and that the mutually opposite vertical stands 18, 19 bear on the spacer web 9 and externally on the tubular bodies 11, 12. In order for the introduction of the holder 15 to be facilitated, the vertical stands 16, 17 are embodied so as to be longer than the vertical stands 18, 19, the former on the free ends 16*a*, 17*a* thereof in each case having one encircling chamfer 16*b*, 17*b*. The vertical stands 18, 19 at the free ends 18*a*, 19*a* thereof, towards the spacer web 9, are likewise equipped with a chamfer in order for the introduction of the spacer web 9 between the vertical stands 18, 19 to be facilitated.

Figure 4A:
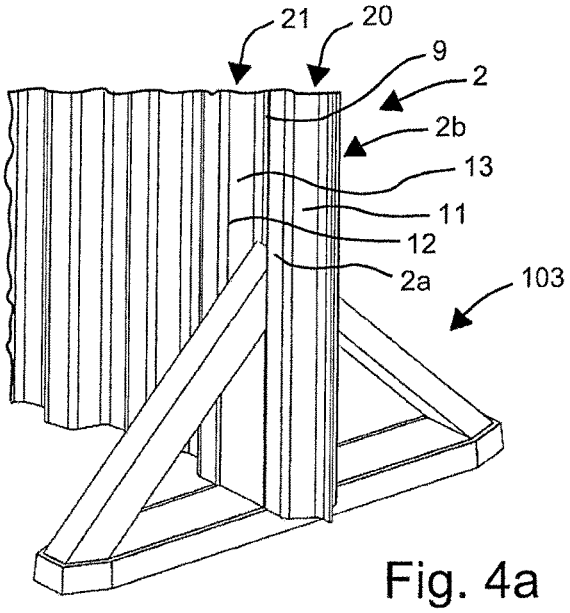
FIG. 4*a* shows a perspective view of the corner region shown in FIG. 3*a*, having a floor support push-fitted thereinto, forming a second variant embodiment of a floor support.
Figure 4B:
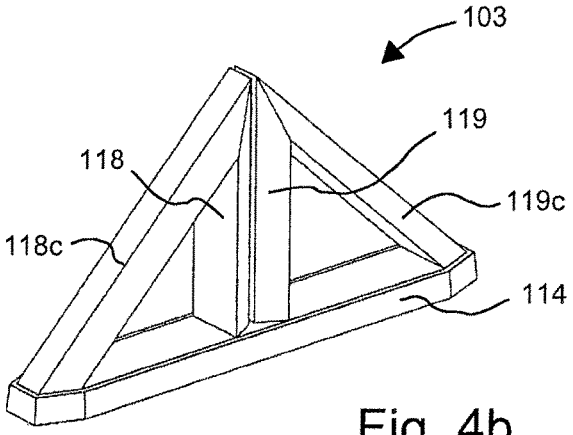
FIGS. 4*b*, 4*c* show the second variant of embodiment of the floor support in a stand-alone view and a plan view of the illustration of FIG. 4*a;*
Figure 4C:
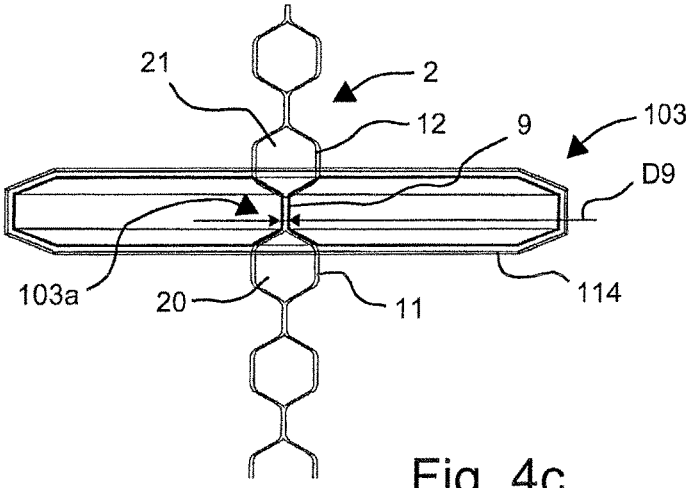

A perspective view of the corner region 13 shown in FIG. 3*a* of the wall element 2 having a floor support 103 push-fitted thereinto is shown in FIG. 4*a*, forming a second variant of embodiment of a floor support. The floor support 103 herein is embodied such that the floor support 103 comprises two vertical stands 118, 119 (cf. also FIG. 4*b*) which outside cavities 20, 21 of the tubular bodies 11, 12 bear on the front visible side 2*a* and on the rear visible side 2*b* of the wall element 2 in the region of the spacer web 9 and of the adjacent tubular bodies 11, 12, the vertical stands 118, 119 gripping the wall element 2 in a clamping manner. For stabilizing, the vertical stands 118 and 119 each also have one support stay 118*c* and 119*c*, respectively. The floor support 103 in FIG. 4*b* is shown in a stand-alone view, and a plan view of the arrangement shown in FIG. 4*a* is illustrated in FIG. 4*c*. It can be seen in the plan view how the wall element 2 is jammed in a gap 103*a* of the floor support 103, the gap 103*a* being configured between the two vertical stands 118 and 119, and how a foot 114 of the floor support 103 is aligned so as to be transverse to the wall element. The spacer web 9 herein has a thickness D9 to which the gap 103*a* is adapted. Deviating from the illustration of FIG. 4*a*, the wall element 2 in the illustration of FIG. 4*c* extends to the left and to the right beyond the floor support 103.

Figure 5A:
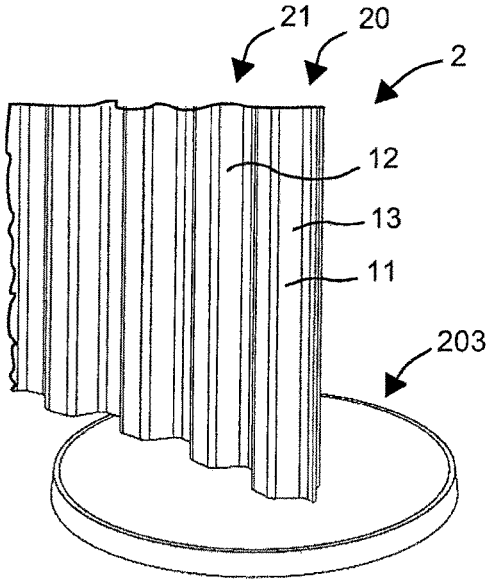
FIG. 5*a* shows a perspective view of the corner region shown in FIG. 3*a*, having a floor support push-fitted thereinto, forming a third variant of embodiment of a floor support.
Figure 5B:
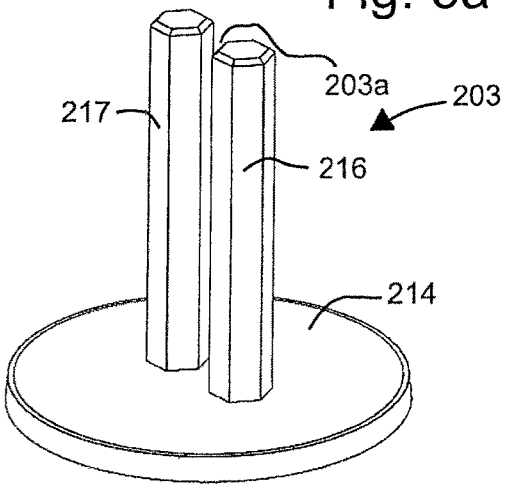
FIGS. 5*b*, 5*c* show the third variant of embodiment of the floor support in a stand-alone view and a plan view of the illustration of FIG. 5*a;*
Figure 5C:
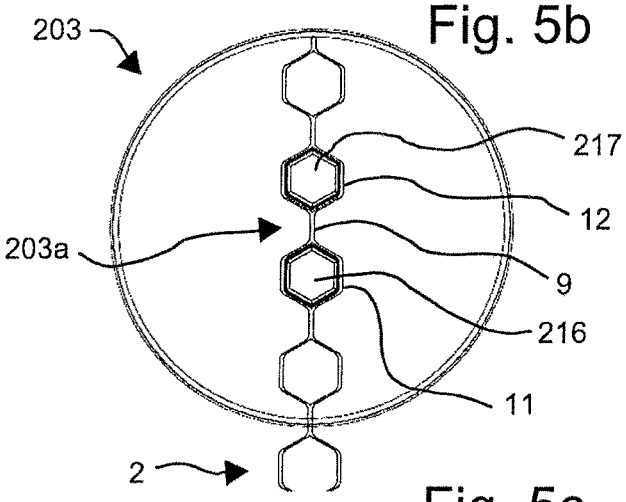

A perspective view of the corner region 13 shown in FIG. 3*a* having a floor support 203 push-fitted thereinto is shown in FIG. 5*a*, forming a third variant of embodiment of a floor support. The floor support 203 herein is embodied such that the floor support 203 comprises two vertical stands 216, 217 (cf. FIG. 5*b*) which are push-fitted into the cavities 20, 21 of the tubular bodies 11, 12. The floor support 203 in FIG. 5*b* is shown in a stand-alone view, and a plan view of the arrangement shown in FIG. 5*a* is illustrated in FIG. 5*c*. The two vertical stands 216 and 217 are disposed so as to be mutually spaced apart on a foot 214, such that a gap 203*a* in which the spacer web 9 is substantially received is configured between the two vertical stands 216 and 217, the spacer web 9 being disposed between the tubular bodies 11, 12 into which the vertical stands 216, 217 are push-fitted. It can be seen in the plan view (cf. FIG. 5*c*) how the wall element 2 receives the vertical stands 216 and 217. Deviating from the illustration of FIG. 5*a*, the wall element 2 in the illustration of FIG. 5*c* extends to the left and to the right beyond the floor support 203.

Figure 6A:
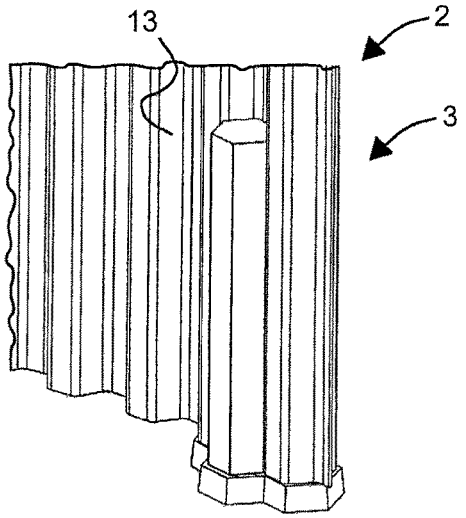
FIG. 6*a* shows a perspective view of the corner region shown in FIG. 3*a*, having a floor support push-fitted thereinto, the floor support corresponding to the first variant of embodiment of the floor support as known from FIGS. 1 and 3*b;*
Figure 6B:
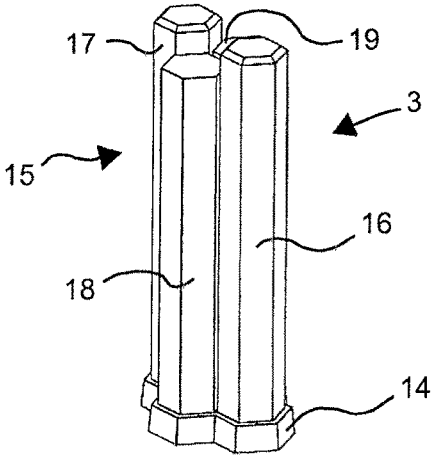
FIGS. 6*b*, 6*c* show the first variant of embodiment of the floor support in a stand-alone view and a plan view of the illustration of FIG. 6*a;*
Figure 6C:
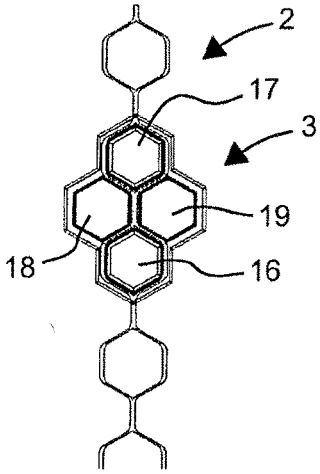

A perspective view of the corner region 13 shown in FIG. 3*a* having the floor support 3 as known from FIGS. 1 and 3*b* is shown in FIG. 6*a*, forming the first variant of embodiment of the floor support. In terms of the perspective illustration of the floor support 3 in FIG. 6*b*, reference is made to the description pertaining to FIG. 3*b*, wherein the illustration of FIG. 6*b* in relation to the illustration of FIG. 3*b* has been rotated slightly to the left about the vertical axis. According to the description above, it can then be seen from the plan view (cf. FIG. 6*c*) how the wall element 2 is held between the four vertical stands 16, 17, 18, and 19. Deviating from the illustration of FIG. 6*a*, the wall element 2 in the illustration of FIG. 6*c* extends to the left and to the right beyond the floor support 3.

Figure 7:
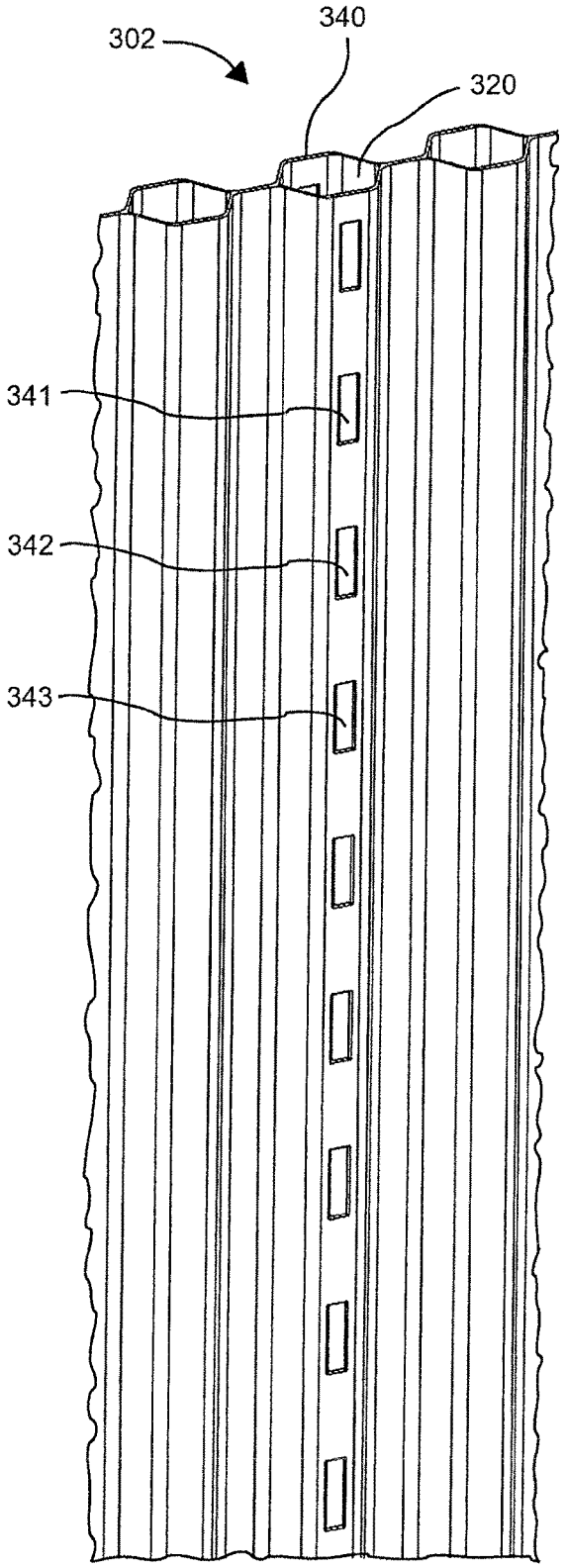
FIG. 7 shows a second variant of embodiment of a wall element having clearances.

A second variant of embodiment of a wall element 302 is shown in a detailed view in FIG. 7. The wall element 302 has a tubular body 340 having a cavity 320 which at a regular spacing has a multiplicity of clearances 341, 342, 343 (identified in an exemplary manner only) which are configured as rectangular slots or punched cut-outs, respectively.

Figure 8:
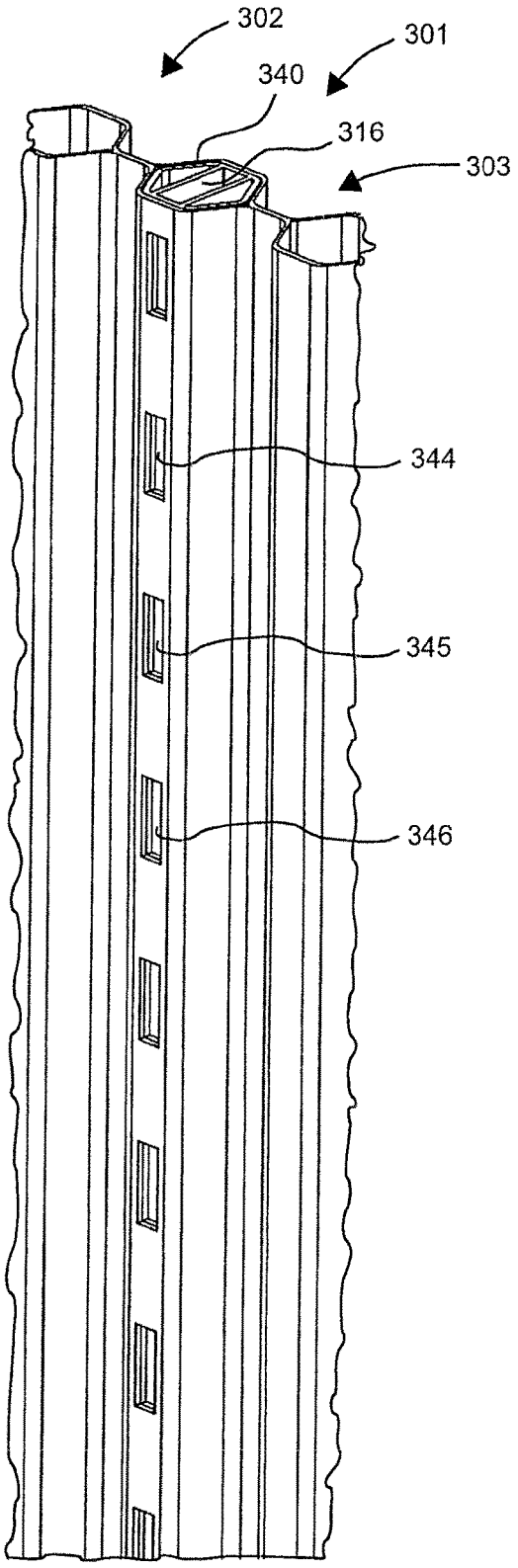
FIG. 8 shows a second variation of embodiment of a partition wall which is constructed using the wall element shown in FIG. 7.

A detailed view of a second variant of embodiment of a partition wall 301 in which the wall element 302 shown in FIG. 7 is installed is shown in FIG. 8. A vertical stand 316 of a floor support 303 is push-fitted into the tubular body 340 of the wall element 302. This vertical stand 316 has a multiplicity of coupling mechanisms 344, 345, 346 (identified in an exemplary manner only) which are aligned to the clearances 341, 342, 343 of the wall element 302 such that the coupling mechanisms 344, 345, 346 are accessible from the outside.

Figure 9:
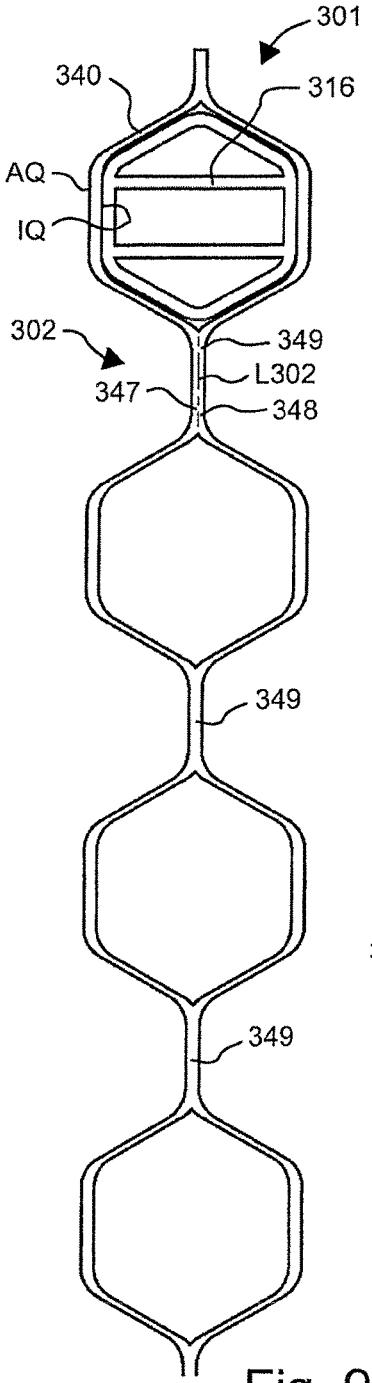
FIG. 9 shows a fragmented plan view of the second variant of embodiment of a partition wall shown in FIG. 8.

A plan view of the illustration of FIG. 8 is shown in FIG. 9, wherein the plan view shows a slightly different fragment of the partition wall 301, the tubular body 340 and the hollow profile 340, respectively, being however illustrated in full. It can be seen in the plan view that an internal cross section IQ and an external cross section AQ of the hollow profile 340 are configured so as to be hexagonal, and that the vertical stand 316 is adapted to the internal cross section IQ so as to fill the tubular body 340 such that the latter is held without play on the vertical stand 316. It is furthermore indicated by way of a dashed line L302 in the view of FIG. 9 that the wall element 302 is formed from a first layer 347 and from a second layer 348, the layers being connected to one another in the region of the spacer webs 349.

Figure 10:
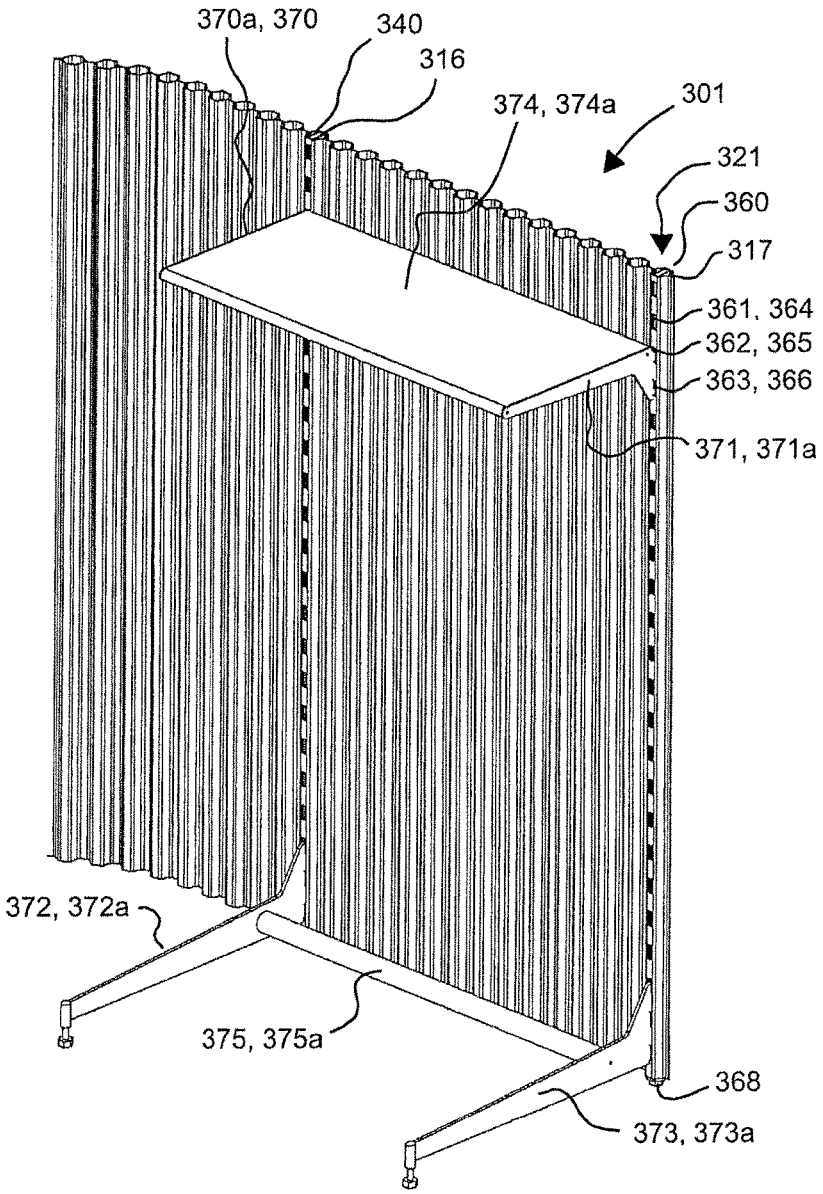
FIG. 10 shows a perspective view of the second variant of embodiment of the partition wall, wherein the latter is shown with additional add-on parts and furniture parts.

The second variant of embodiment of the partition wall 301 is shown in a wider scope in a perspective view in FIG. 10. The partition wall 301 comprises yet a second tubular body 360 having a cavity 321, which just like the first tubular body 340 comprises clearances 361, 362, 363, and a vertical stand 317 having coupling mechanisms 364, 365, 366 being push-fitted into the cavity 321. The remaining tubular bodies of the wall element 302 that are not identified are embodied without clearances, wherein, as is the case of the wall element of the first variant of embodiment of the partition wall, all tubular bodies of the wall element are connected by spacer webs and are mutually spaced apart. The partition wall 301 furthermore comprises four add-on parts 370, 371, 372, and 373 which are configured as holding arms 370*a*, 371*a*, and as support feet 372*a*, 373*a*. Additionally thereto, the partition wall 301 comprises furniture parts 374, 375 which are configured as a shelf base 374*a* and as a shelf rod 375*a*. The shelf base 374*a* is carried by the holding arms 370*a*, 371*a*, and the shelf rod 375*a* is disposed between the support feet 372*a*, 373*a* in order to stabilize the latter. Furthermore to be seen in FIG. 10 is a foot 368 which is connected to the vertical stand 317.

Figure 11:
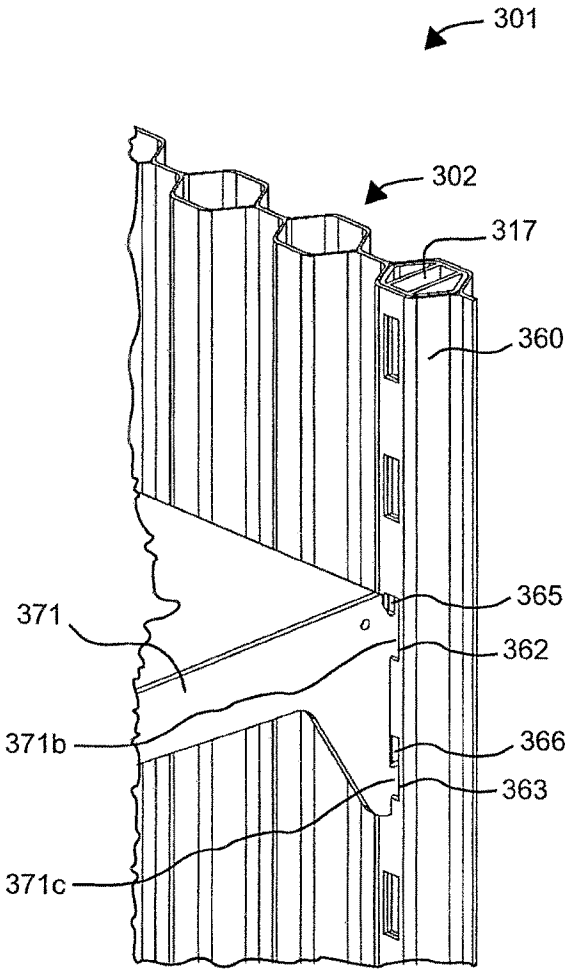
FIG. 11 shows a detailed view to that of FIG. 10.

As can be seen from the detailed view shown in FIG. 11, pertaining to FIG. 10, of the add-on part 371, the add-on part 371 comprises two flanges 371*b* and 371*c* which are configured as hook-type cams by way of which the add-on part 371, so as to pass through the clearances 362, 363, engages in the coupling mechanism 365, 366 of the vertical stand 317. The other add-on parts 370, 372, 373 (cf. FIG. 10) are fastened in a comparable manner.

Figure 12:
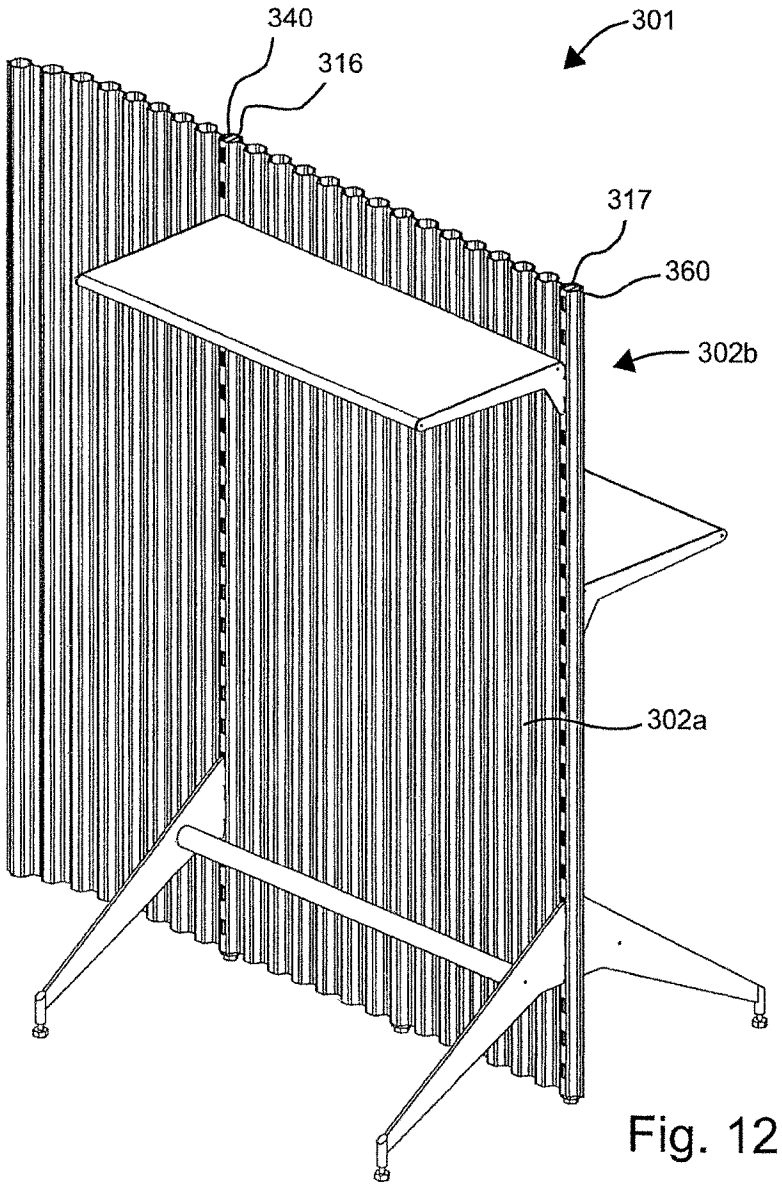
FIG. 12 shows the second variant of embodiment of the partition wall having further add-on parts and further furniture parts.

The partition wall 301 is shown in a further specification grade in FIG. 12, in which further add-on parts and further furniture parts have been added to the partition wall 301 such that the latter has utilization potentials not only toward the front visible side 302*a* thereof, but also additional utilization potentials toward the rear visible side 302*b* of the partition wall 301. To this end, the tubular bodies 340, 360 opposite the clearances 361, 362, 363 thereof have further clearances, and the vertical stands 316, 317 are accordingly also provided with further coupling mechanisms.

Figure 13:
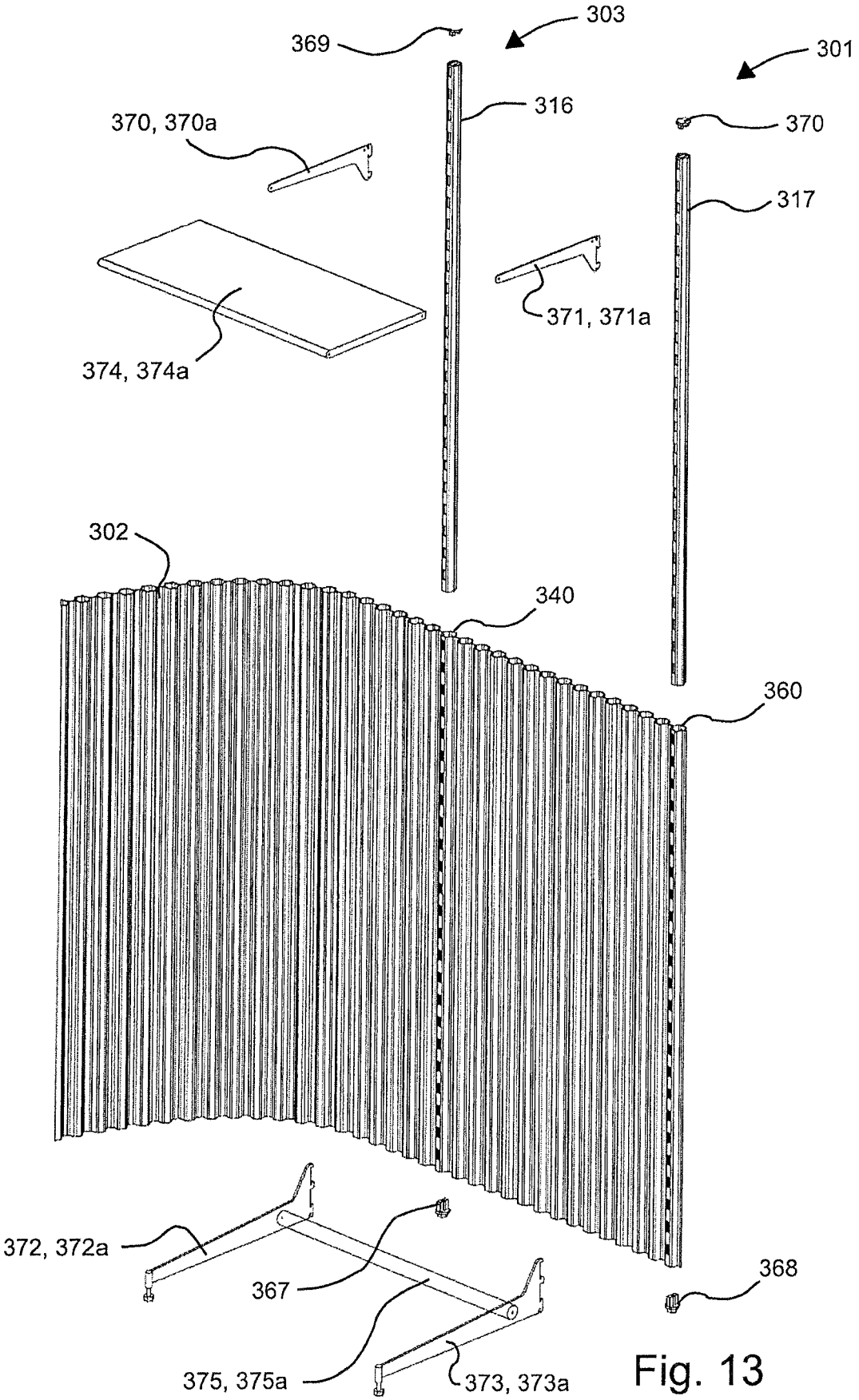
FIG. 13 shows an exploded view of the second variant of embodiment of the partition wall shown in FIG. 10.

An exploded view pertaining to the specification state of the partition wall 301 as illustrated in FIG. 10 is shown in FIG. 13 such that the individual components can be more readily identified, and a foot 367 which is associated with the first vertical stand 316 and together with the latter forms a floor support 303 also being identifiable. Cover caps 369, 370 by way of which the vertical stands 316, 317 can be closed off at the top are furthermore shown.

Figure 14:
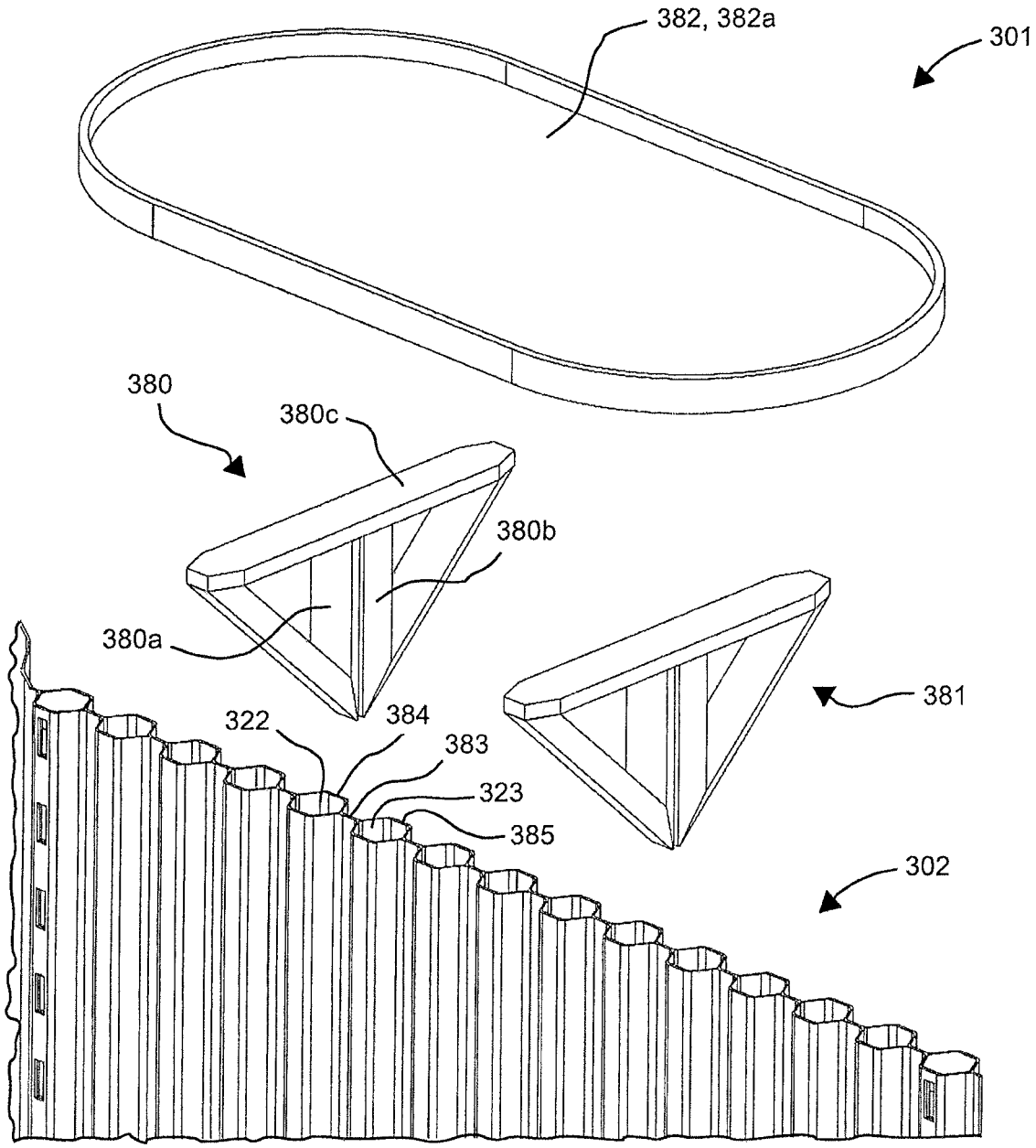
FIG. 14 shows an exploded view of a detail of a further specification grade of the second variant of embodiment of the partition wall, wherein the partition wall comprises two heads and one accessory part.
Figure 15:
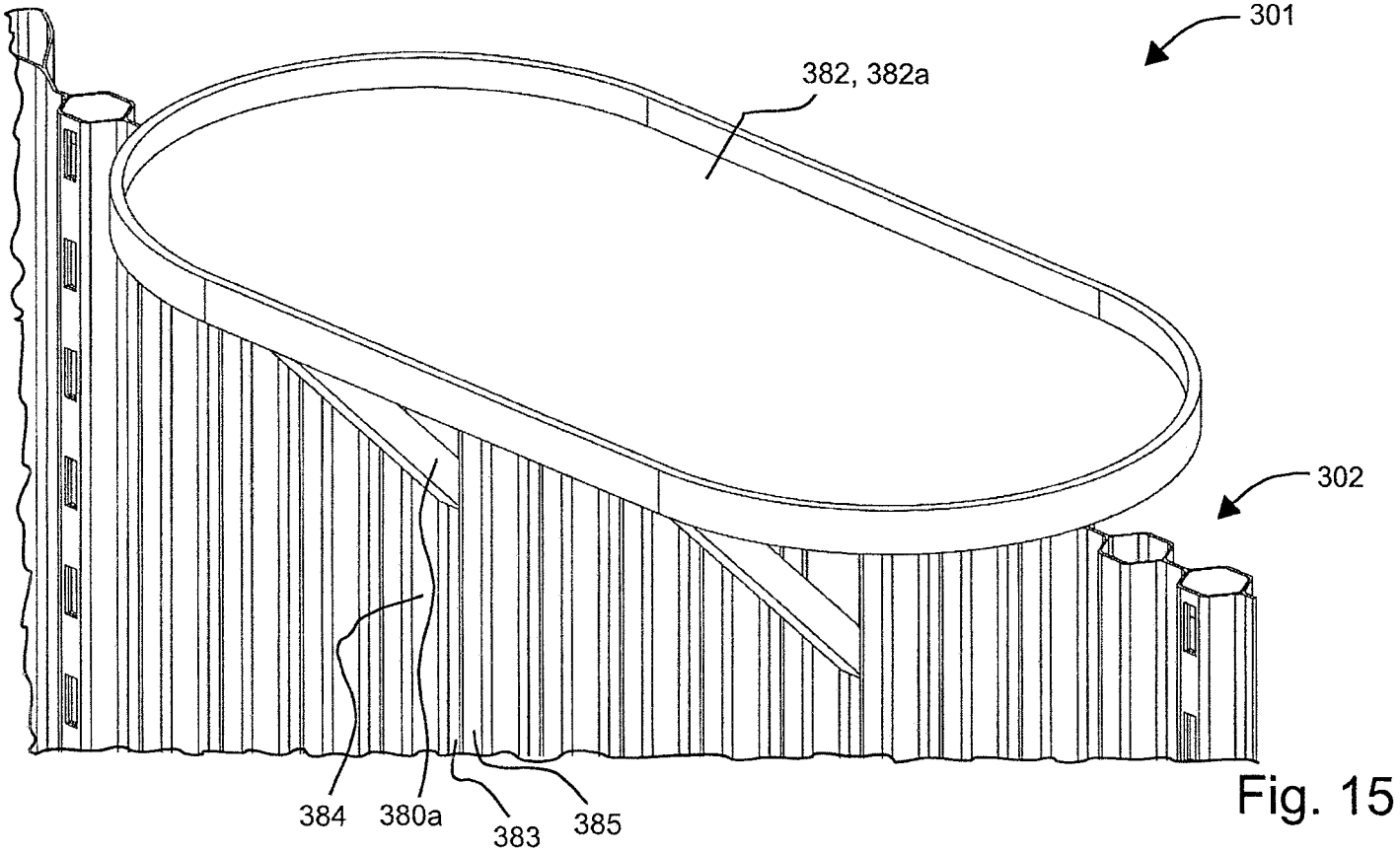
FIG. 15 shows a view of the specification grade shown in FIG. 14, in an assembled state.

An exploded view of a detail of a further specification grade of the second variant of embodiment of the partition wall 301 is shown in F 14, wherein the partition wall 301 additionally comprises two heads 380, 381 and one accessory part 382. The head 380 comprises two anchors 380*a*, 380*b* and one adapter 380*c*. The adapter 380*c* herein is connected to the two anchors 380*a*, 380*b*. The head 380 by way of the two anchors 380*a*, 380*b* thereof is placeable from above onto the wall element 302 in such a manner that the anchors 380*a*, 380*b* bear laterally on a spacer web 383 and on tubular bodies 384, 385 which have cavities 322, 323 and are adjacent to the spacer web 383, thus gripping the wall element 302 in a clamping manner. The fixation of the head 381 is carried out correspondingly. The accessory part 382 which is configured as a storage unit 382*a* is then held by the adapters 380*c* and 381*c*. A view of the specification grade illustrated in FIG. 14 is shown in an assembled state in FIG. 15.

Figure 17:
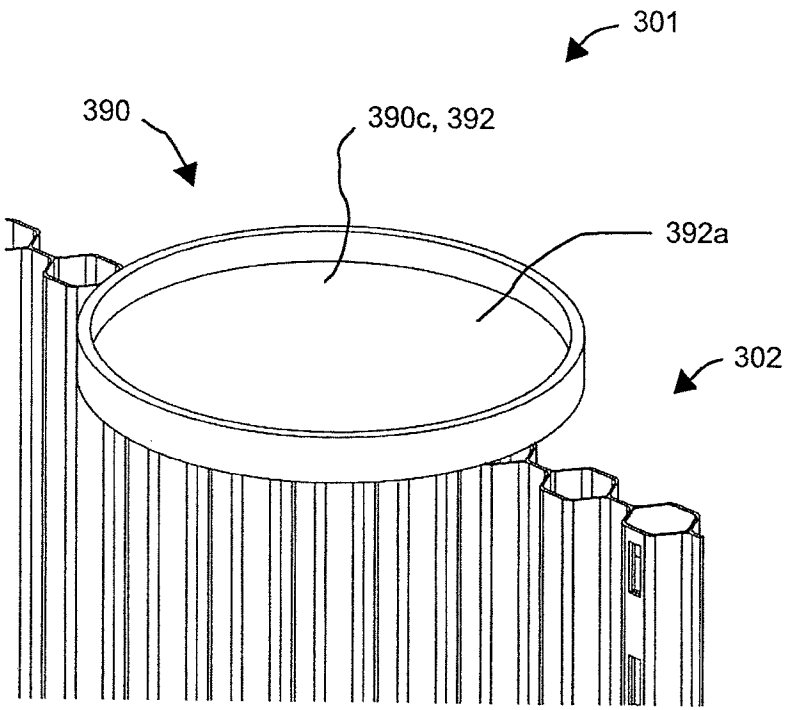
FIG. 17 shows a view of the specification grade shown in FIG. 16, in an assembled state.
Figure 16:
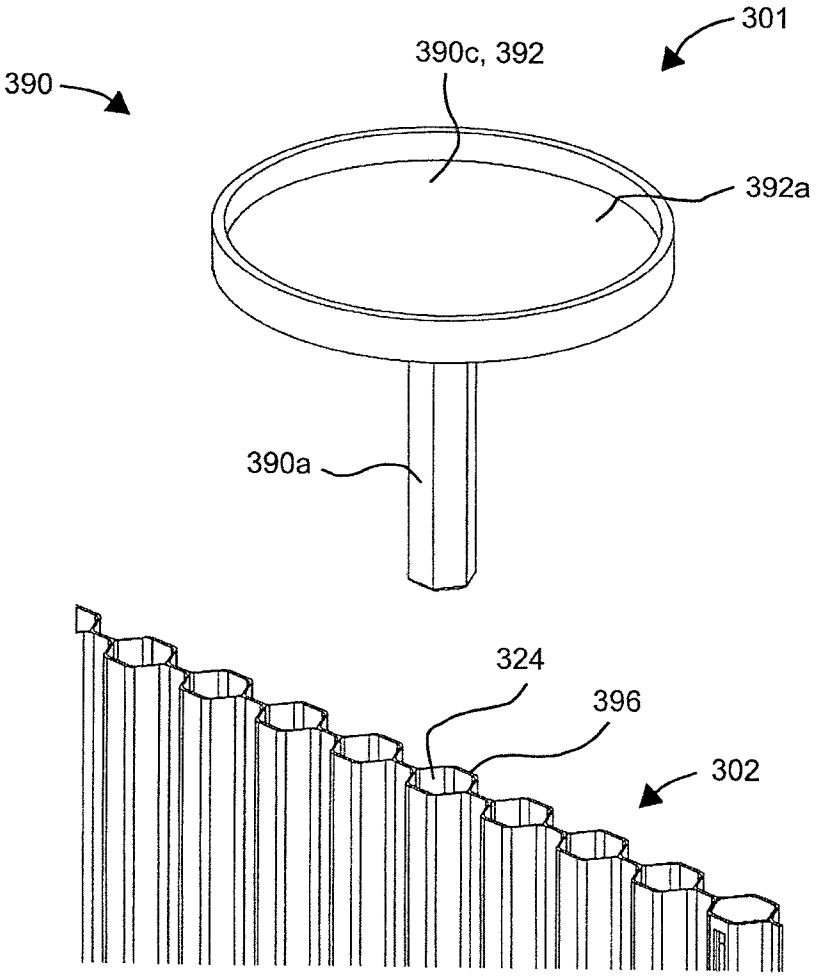
FIG. 16 shows an exploded view of a detail of a further specification grade of the second variant of embodiment of the partition wall, wherein the partition wall comprises one head and one accessory part.

An exploded view of a detail of a further specification grade of the second variant of embodiment of the partition wall 301 in shown in FIG. 16, wherein the partition wall 301 additionally comprises a head 390. The head 390 comprises an anchor 390*a* and an adapter 390*c*. The adapter 390*c* herein is connected to the anchor 390*a*. The head 390 by way of the anchor 390*a* thereof is placeable from above onto the wall element 302 in such a manner that the anchor 390*a* is received without play in a cavity 324 of a tubular body 396 of the wall element 302. The adapter 390*c* as an accessory part 392 forms a storage unit 392*a*. A view of the specification grade illustrated in FIG. 16 is shown in an assembled state in FIG. 17.

Figure 18:
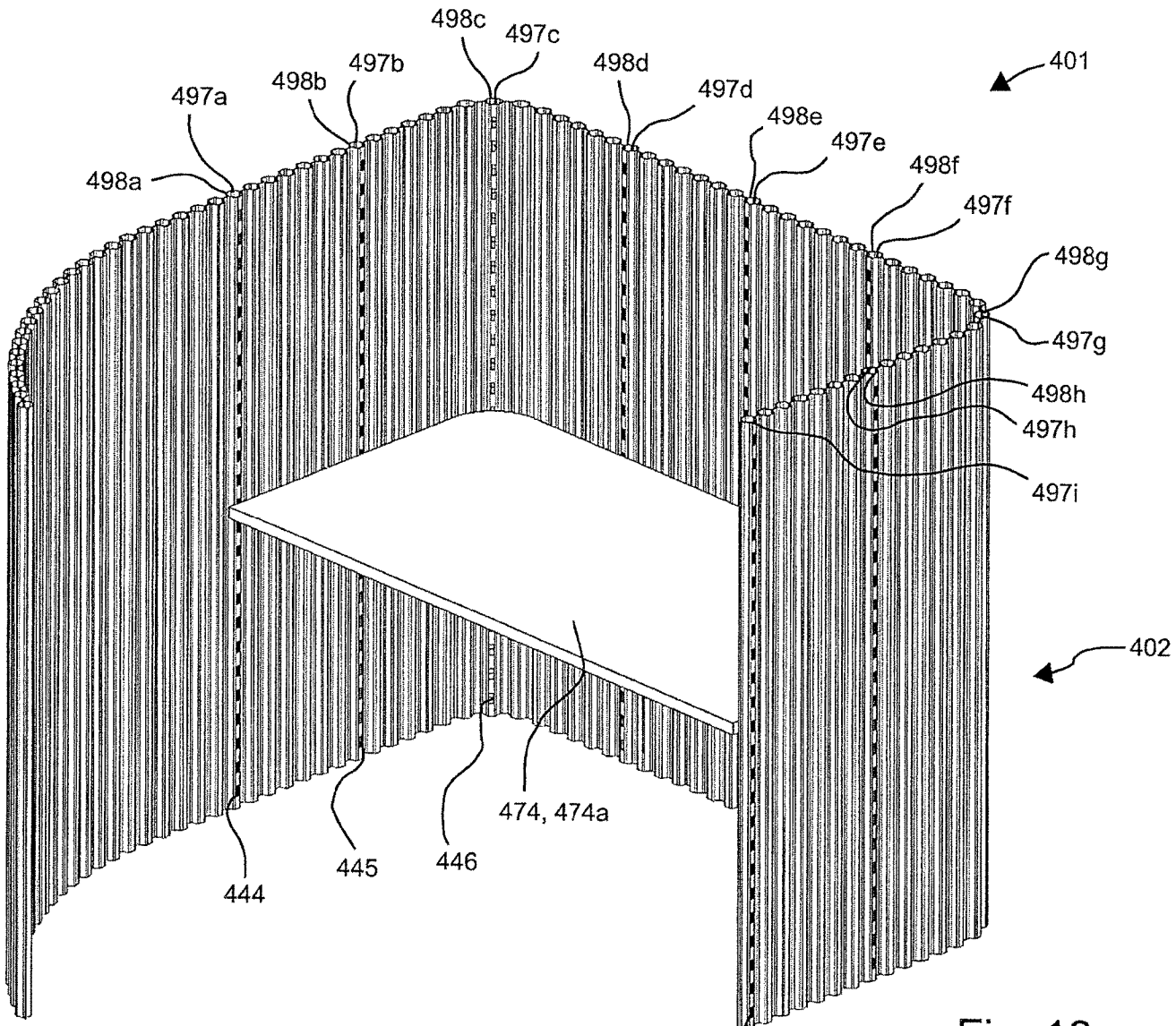
FIG. 18 shows a perspective view of a third variant of embodiment of a partition wall, wherein the partition wall comprises a desktop as the furniture part.

A perspective view of a third variant of embodiment of a partition wall 401 is shown in FIG. 18, wherein the partition wall 401 as a furniture part 474 comprises a desktop 474*a*. The partition wall 401 comprises seven vertical stands 497*a*-497*i* which are received in tubular bodies 498*a*-498*i* of a wall element 402 of the partition wall 401 and comprise coupling mechanisms 444-446 (identified in an exemplary manner only), the desktop 474*a* by holding arms (not illustrated) being hooked into the coupling mechanisms 444-446. The desktop 474*a* is carried by the wall element 402 on three sides. It is also provided that the desktop 474*a* or a board having another depth is used as a seat, the latter being suspended at a height corresponding to the requirements. Alternatively or additionally, it is likewise provided for a shelf unit to be configured in the manner of the desktop by suspending a plurality of boards on top of one another.

Figures 19, 20:
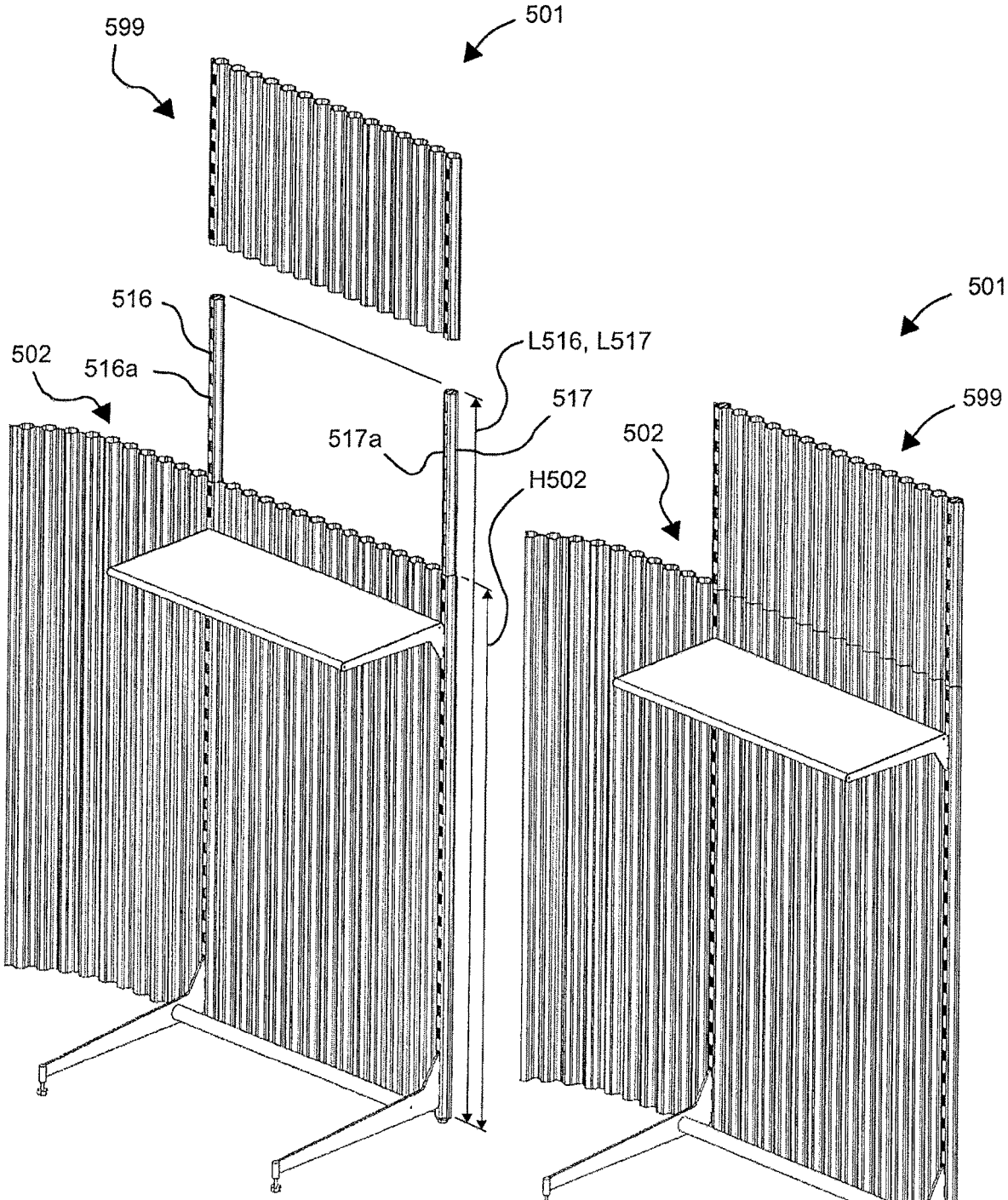
FIG. 19 shows an exploded view of a fourth variant of embodiment of a partition wall, wherein the partition wall, in addition to a first wall element, comprises a second wall element.
FIG. 20 shows a view of the fourth variant of embodiment shown in FIG. 19, in an assembled state.

An exploded view of a fourth variant of embodiment of a partition wall 501 is shown in FIG. 19, wherein the partition wall 501 in addition to a first wall element 502 comprises a second wall element 599. In principle, the partition wall 501 is of comparable construction to that of the partition wall shown in FIG. 10. Accordingly, reference is made to the description of the figure pertaining to FIG. 10. As opposed to the partition wall shown in FIG. 10, the partition wall 501 shown in FIG. 19 comprises vertical stands 516 and 517 which have a length L516, L517 which is longer than a height H502 of the first wall element 502 in the region of the vertical stands 516, 517. The vertical stands 516, 517 by way of the end portions 516*a*, 517*a* thereof that project beyond the first partition wall 502 are push-fitted into the second wall element 599 such that the latter forms a partition wall elevation.

A view of the fourth variant of embodiment of the partition wall 501 illustrated in FIG. 19 is shown in an assembled state in FIG. 20.

LIST OF REFERENCE SIGNS

1 Partition wall (1st variant)
2 Wall element
2*a* Front visible side of 2
2*b* Rear visible side of 2
3-6 Floor support
7 Base edge of 2
8 Head edge of 2
9 Spacer web
9*a*, 9*b* Edge of 9
10 Spacer web
11, 12 Tubular body/hollow profile
13 Lower corner region of 2
14 Foot of 3
15 Holder of 3
16-19 Vertical stand
16*a*-19*a* Free end of 16*a*-19*a*
16*b*, 17*b* Encircling chamfer on 16*a*, 16*b*
20, 21 Cavity of 11, 12
103 Floor support (2nd variant of embodiment)
103*a* Gap
114 Foot
118, 119 Vertical stand
118*c*, 119*c* Support stay of 118, 119
203 Floor support (3rd variant of embodiment)
203*a* Gap
214 Foot
216, 217 Vertical stand
301 Partition wall (2nd variant)
302 Wall element
302*a* Front visible side of 302
302*b* Rear visible side of 302
303 Floor support
304 Floor support
316 Vertical stand in 340
317 Vertical stand in 360
320-324 Cavity of 320, 321, 384, 385, 396
340 Tubular body
341-343 Clearance in 340
344-346 Coupling mechanism of 316
347 First layer of 302
348 Second layer of 302
349 Spacer web
360 Second tubular body
361-363 Clearance in 360
364-366 Coupling mechanism of 317
367 Foot of 316
368 Foot of 317
370-373 Add-on parts
370*a*, 371*a* Holding arm
371*b*, 371*c* Flange of 371
372*a*, 373*a* Support foot
374, 375 Furniture parts
374*a* Shelf base
375*a* Shelf rod
376, 377 Cover cap
380 Head
380*a*, 380*b* Anchor
380*c* Adapter
381 Head
381*c* Adapter
382 Accessory part
382*a* Storage unit
383 Spacer web
384, 385 Tubular body
390 Head
390*a* Anchor
390*c* Adapter
392 Accessory part
392*a* Storage unit
396 Tubular body
401 Partition wall
402 Wall element
444-446 Coupling mechanism of 497*a*
474 Furniture part
474*a* Desktop
497*a*-497*i* Vertical stand
498*a*-498*i* Tubular body of 402
501 Partition wall
502 First wall element
516, 517 Vertical stand
516*a*, 517*a* End portion of 516, 517
599 Second wall element
AQ External cross section
B Floor
D9 Thickness of 9
H502 Height of 502
IQ Internal cross section
L11, L12 Longitudinal axis of 11 or 12, respectively
L302 Line in FIG. 9
L516, L517 Length of 516, 517
R Room
SV Stand device

The invention claimed is:

1. A partition wall comprising:

a wall element; and a stand device, wherein the wall element comprises a multiplicity of tubular bodies, each having a cavity, and which are vertically aligned in a room in which the partition wall is situated, wherein the wall element comprises a plurality of spacer webs, wherein one of the plurality of spacer webs is in each case disposed between adjacent ones of the multiplicity of tubular bodies of the wall element such that the multiplicity of the tubular bodies are aligned to be mutually parallel and mutually spaced apart, wherein the stand device comprises at least two floor supports, wherein each of the at least two floor supports comprises a foot and a holder, wherein each holder is connected to the wall element, wherein each holder comprises a vertical stand, wherein the vertical stand of the holder of each of the at least two floor supports is adapted to the cavity of one of the multiplicity of tubular bodies of the wall element, such that the one of the multiplicity of tubular bodies is vertically aligned with the respective vertical stand when the respective vertical stand is plug-fitted into the one of the multiplicity of tubular bodies, wherein at least one of the vertical stands comprises at least one coupling opening, wherein the at least one of the vertical stands is plug-fitted into the cavity of the one of the multiplicity of tubular bodies of the wall element, wherein the at least one coupling opening of the at least one of the vertical stands is disposed in a region of the cavity into which the at least one of the vertical stands is plug-fitted, wherein the one of the multiplicity of tubular bodies into which the at least one of the vertical stands is plug-fitted has at least one clearance which is aligned to the at least one coupling opening, the at least one coupling opening being accessible from the outside by the at least one clearance, wherein the partition wall comprises at least one add-on part, and wherein the at least one add-on part comprises at least one flange that passes through the at least one clearance of the one of the multiplicity of tubular bodies of the wall element, and is connected to the at least one coupling opening of the at least one of the vertical stands.

2. The partition wall according to claim 1, wherein the multiplicity of tubular bodies are configured as hollow profiles, wherein the hollow profiles have an internal cross sectional shape that is circular or polygonal, and wherein an external cross sectional shape of the hollow profiles is circular or polygonal.

3. The partition wall according to claim 1, wherein individual ones of the spacer webs are each connected by opposite edges to respective ones of the adjacent ones of the multiplicity of tubular bodies.

4. The partition wall according to claim 1, wherein the wall element comprises at least two layers, wherein a first layer of the at least two layers forms a front visible side of the wall element, and wherein a second layer of the at least two layers forms a rear visible side of the wall element, and wherein the first and second layers, in a region of the spacer webs, bear on one another and are connected to one another in a planar manner and are adhesively bonded, welded and/or sewn to one another.

5. The partition wall according to claim 1, wherein the at least one add-on part is configured as a holding arm, as a support foot, as a cross stay, or as a diagonal stay.

6. The partition wall according to claim 1, wherein the partition wall comprises at least one furniture part, and wherein the at least one furniture part is directly connected to at least one of the at least one of the vertical stands and/or indirectly connected to at least one of the at least one of the vertical stands, by the at least one add-on part.

7. The partition wall according to claim 1, wherein the plurality of spacer webs of the wall element are elastically deformable and flexural about bending axes that run parallel with respect to longitudinal axes of the multiplicity of tubular bodies, and/or wherein the wall element, at a plurality of transition points between the spacer webs and the adjacent one of the multiplicity of tubular bodies, is elastically deformable and flexural about the bending axes that run parallel with respect to the longitudinal axes of the multiplicity of tubular bodies.

8. The partition wall according to claim 1, wherein the partition wall comprises at least one head, wherein the at least one head comprises at least one anchor and one adapter, wherein the adapter is connected to the at least one anchor, and wherein the at least one anchor, is either plug-fittable from above into at least one of the cavities of the multiplicity of tubular bodies of the wall element, or into the at least one of the vertical stands that is plug-fitted into the cavity of the one of the multiplicity of tubular bodies, and/or placeable from above onto the wall element in such that the at least one anchor bears laterally on at least one of the spacer webs and/or on at least one of the multiplicity of tubular bodies.

9. The partition wall according to claim 8, wherein the partition wall comprises accessory parts selected from the group consisting of storage units, bezels, and lamps, which are fastenable to the adapter.

10. The partition wall according to claim 1, wherein the partition wall comprises at least one second wall element, wherein each vertical stand has a length that is greater than a height of the wall element in a region of a respective one of the at least two floor supports, and wherein each vertical stand is connected to the second wall element such that each vertical stand is positioned above the wall element to correspond to an alignment of the vertical stands.

11. The partition wall according to claim 2, wherein the internal cross sectional shape of the hollow profiles of the multiplicity of tubular bodies is hexagonal.

12. The partition wall according to claim 2, wherein the external cross sectional shape of the hollow profiles of the multiplicity of tubular bodies is hexagonal.

* * * * *